US010549880B2

(12) United States Patent
Tacchi et al.

(10) Patent No.: US 10,549,880 B2
(45) Date of Patent: Feb. 4, 2020

(54) RIGID BOX FOR SMOKING ARTICLES AND RESPECTIVE PRODUCTION METHOD

(71) Applicant: G.D SOCIETA' PER AZIONI, Bologna (IT)

(72) Inventors: Alver Tacchi, Bologna (IT); Stefano Negrini, Calderara di Reno (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 302 days.

(21) Appl. No.: 15/328,923

(22) PCT Filed: Jul. 31, 2015

(86) PCT No.: PCT/IB2015/055835

§ 371 (c)(1),
(2) Date: Jan. 25, 2017

(87) PCT Pub. No.: WO2016/016868

PCT Pub. Date: Feb. 4, 2016

(65) Prior Publication Data

US 2017/0210505 A1 Jul. 27, 2017

(30) Foreign Application Priority Data

Jul. 31, 2014 (IT) ..... BO2014A0433

(51) Int. Cl.
*B65D 5/50* (2006.01)
*B65B 43/10* (2006.01)
(Continued)

(52) U.S. Cl.
CPC ..... *B65D 5/5002* (2013.01); *A24F 15/00* (2013.01); *B65B 19/26* (2013.01); *B65B 43/10* (2013.01);
(Continued)

(58) Field of Classification Search
CPC ..... A24F 15/00; B65D 5/4204; B65D 5/422; B65D 85/1081; B65D 5/5002;
(Continued)

(56) References Cited

U.S. PATENT DOCUMENTS 306,668 A * 10/1884 Wilson ..... B65D 5/48014 229/120.18
2,833,457 A * 5/1958 Tyrseck ..... B65D 5/5023 206/45.29
(Continued)

FOREIGN PATENT DOCUMENTS

DE 9114788 U1 1/1992
DE 202010009256 U1 8/2010
(Continued)

OTHER PUBLICATIONS

International Search Report for Patent Application No. PCT/IB2015/055835, dated Nov. 6, 2015.
(Continued)

*Primary Examiner* — Alexander M Valvis
*Assistant Examiner* — Katie L Gerth
(74) *Attorney, Agent, or Firm* — Marshall. Gerstein & Borun LLP

(57) ABSTRACT

Rigid box for smoking articles having a parallelepiped shape and provided with: a first panel which defines a top wall; a second panel which is folded 90° with respect to the first panel and defines a first lateral wall; a third panel which is folded 90° with respect to the second panel and defines a bottom wall; a fourth panel which is folded 90° with respect to the third panel and defines a second lateral wall opposite the first lateral wall; a fifth panel which is folded 90° with respect to the fourth panel and rests on an inner surface of the first panel; a sixth panel which is folded 90° with respect to the fifth panel and divides the inner volume of the rigid
(Continued)

box; and a seventh panel which is folded 90° with respect to the sixth panel and rests on an inner surface of the third panel.

15 Claims, 14 Drawing Sheets

(51) Int. Cl.

| | |
|---|---|
| ***B65D 5/54*** | (2006.01) |
| ***A24F 15/00*** | (2006.01) |
| ***B65D 5/02*** | (2006.01) |
| ***B65D 85/12*** | (2006.01) |
| ***B65B 19/26*** | (2006.01) |

(52) U.S. Cl.
CPC ..... *B65D 5/0227* (2013.01); *B65D 5/5405* (2013.01); *B65D 85/12* (2013.01)

(58) Field of Classification Search
CPC .... B65D 5/0227; B65D 85/12; B65D 5/5405; B65D 5/5021; B65B 19/26; B65B 43/10
USPC ..... 53/456
See application file for complete search history.

(56) References Cited

U.S. PATENT DOCUMENTS

| | | | | |
|---|---|---|---|---|
| 5,407,076 | A * | 4/1995 | Sabet | A45D 40/0087 206/472 |
| 5,575,384 | A * | 11/1996 | Saye | B42D 15/045 206/232 |
| 6,386,370 | B1 * | 5/2002 | Wigton | B42D 15/042 206/486 |
| 2002/0070146 | A1 * | 6/2002 | Freeze | B65D 5/0227 206/768 |
| 2008/0029411 | A1 * | 2/2008 | Polloni | B65D 5/422 206/268 |
| 2011/0308986 | A1 | 12/2011 | Lee | |
| 2012/0137633 | A1 * | 6/2012 | Bertuzzi | B65B 19/223 53/410 |
| 2013/0001126 | A1 * | 1/2013 | Gu | B65D 5/4204 206/775 |
| 2013/0192172 | A1 * | 8/2013 | LaTrobe | A47F 5/112 53/472 |

FOREIGN PATENT DOCUMENTS

| | | | |
|---|---|---|---|
| JP | H02141323 | U | 11/1990 |
| JP | H11263330 | A | 9/1999 |
| JP | 3083010 | U | 1/2002 |
| JP | 2005-088975 | A | 4/2005 |
| WO | WO-01/25097 | A1 | 4/2001 |
| WO | WO-01/46031 | A1 | 6/2001 |
| WO | WO-2007/071081 | A1 | 6/2007 |

OTHER PUBLICATIONS

Japanese Patent Application No. 2017-505204, Notice of Reasons for Refusal, dated Jun. 13, 2019.

* cited by examiner

RIGID BOX FOR SMOKING ARTICLES AND RESPECTIVE PRODUCTION METHOD

CROSS-REFERENCE TO RELATED APPLICATIONS

This is the U.S. national phase of International Application No. PCT/IB2015/055835, filed Jul. 31, 2015, which claims the benefit of Italian Patent Application No. BO2014A000433, filed Jul. 31, 2014.

TECHNICAL FIELD

The present invention relates to a rigid box for smoking articles and to a corresponding production method.

The present invention is advantageously applied to a rigid box for a cigar to which the following description will make explicit reference without thereby losing generality.

PRIOR ART

Generally the finest cigars are individually packaged in metal tubes provided with a screw-threaded cap. Recently, a need has been felt to market fine cigars individually packaged in rigid boxes of cardboard (i.e. entirely with no metal parts). In particular, a rigid box of cardboard for a cigar must be able to provide adequate mechanical protection to the cigar itself without using an excessive quantity of packing material and must be produced with relative simplicity in a conventional automatic packing machine.

For the packaging of single cigars the use of standard type rigid boxes of cardboard has been proposed, i.e. parallelepiped shaped having four lateral walls and two end walls. Said rigid boxes of cardboard of standard type use a reduced amount of packing material and can be easily produced in a conventional automatic packing machine, but on the other hand offer a modest mechanical protection to the cigar contained inside; moreover, said rigid boxes of cardboard of standard type do not allow to house, if required, also an accessory (such as a lighter) or a gadget.

In the utility model patent ES1056319U a rigid box of cardboard for a single cigar which offers good mechanical protection to the cigar contained inside is provided; however, this rigid box requires the use of a large amount of packing material and is difficult and complex to produce in a conventional automatic packing machine (also for the fact of requiring the use of two independent blanks).

Documents DE9114788U1, DE202010009256U1, JPH02141323U, U.S. Pat. No. 306,668A, WO0146031A1 and US201130898A1 describe a rigid box comprising a panel that divides the inner volume of the rigid box in two adjacent chambers.

Documents JPH02141323U and WO0146031A1 describe that a top wall of the box has through-holes which are formed corresponding to respective chambers, leading inside the chambers, and provide access to the chambers themselves from outside the box; the presence of said through-holes facilitates viewing the articles contained inside the chambers, but on the other hand also increases the possibility that the articles could accidentally come out (and even only partially) from the chambers (for example when the box is transported for a long time in a garment pocket or in a purse or even when the box is produced in the packing machine). To limit the risk of an undesired exiting of the articles from the through-holes of the upper wall, it has been proposed to limit the size of the through-holes themselves; however, this solution greatly penalizes the functionality of the through-holes, as it much restricts the view of the articles contained in the chambers.

DESCRIPTION OF THE INVENTION

The object of the present invention is to provide a rigid box for smoking articles that is free from the drawbacks described above and is, at the same time, easy and inexpensive to manufacture; further object of the present invention is to provide a method for producing said rigid box for smoking articles.

According to the present invention, a rigid box for smoking articles and a respective production method are provided, as claimed in the attached claims.

BRIEF DESCRIPTION OF THE DRAWINGS

The present invention will now be described with reference to the accompanying drawings, which illustrate a non-limitative embodiment, wherein.

PREFERRED EMBODIMENTS OF THE INVENTION

Figure 1:
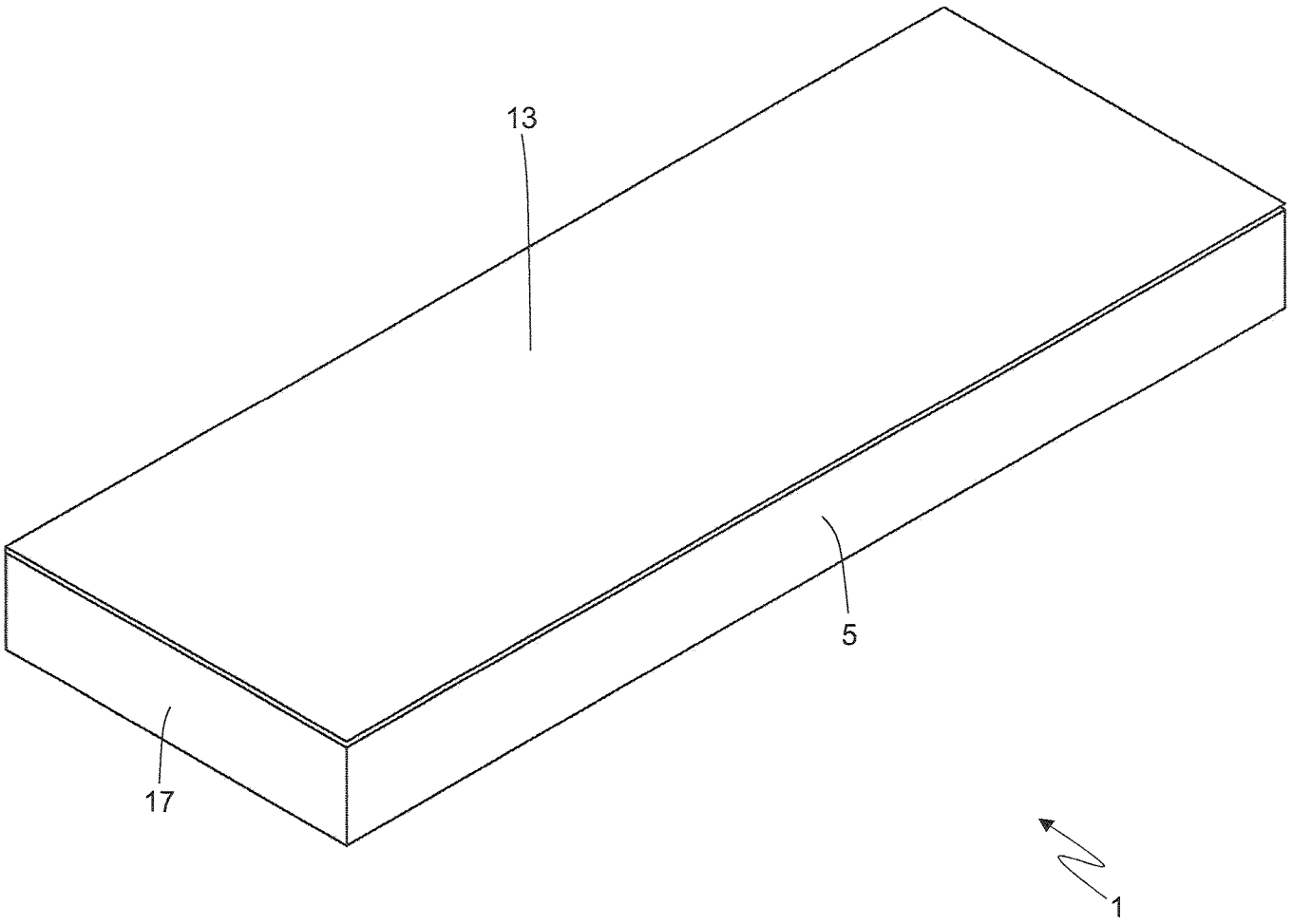
FIG. 1 is a front perspective view and in a closed configuration of a rigid box for smoking articles produced according to the present invention and devoid of its own content.
Figure 13:
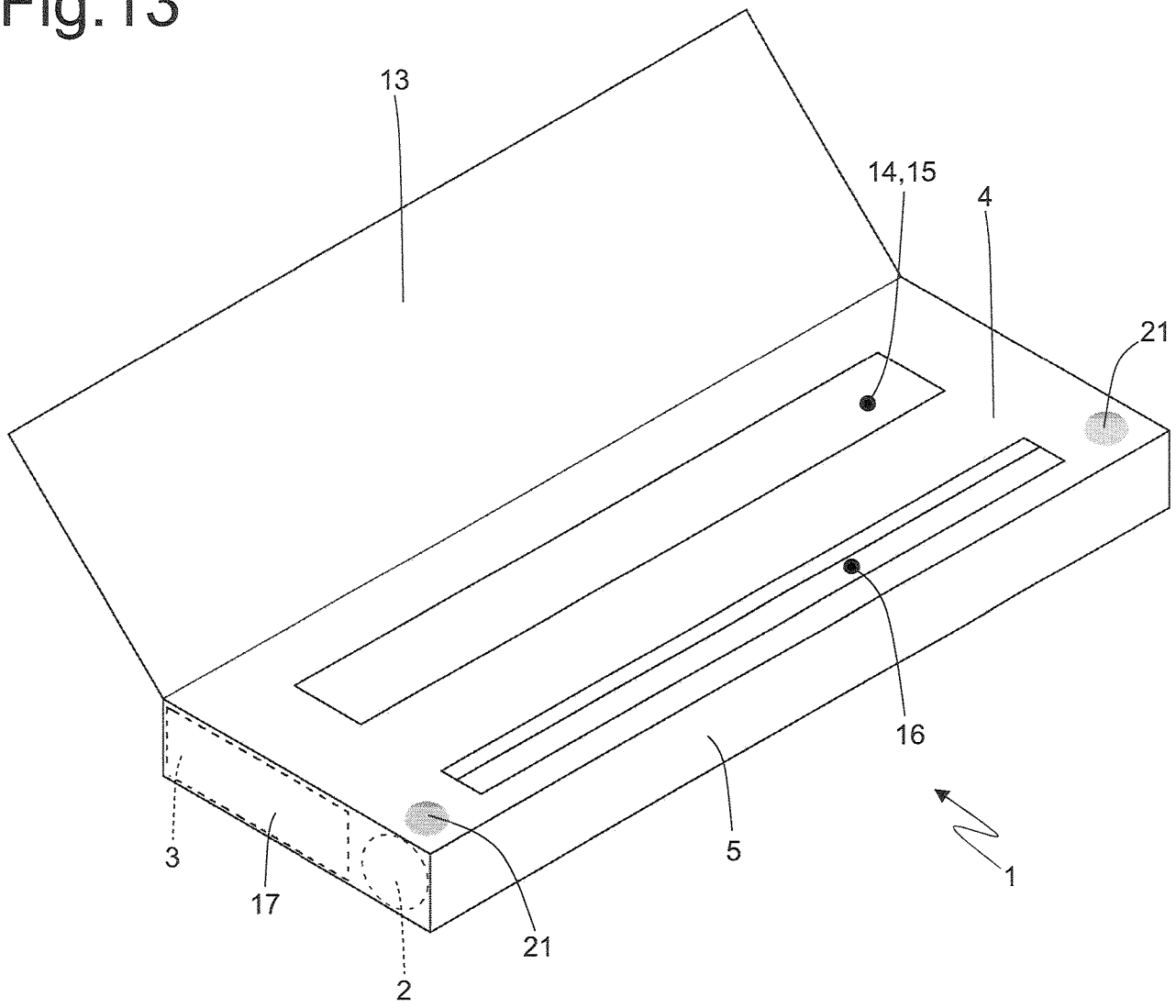
FIG. 13 is a front perspective view of the rigid box of FIG. 1 in an open configuration and devoid of its own content.
Figure 14:
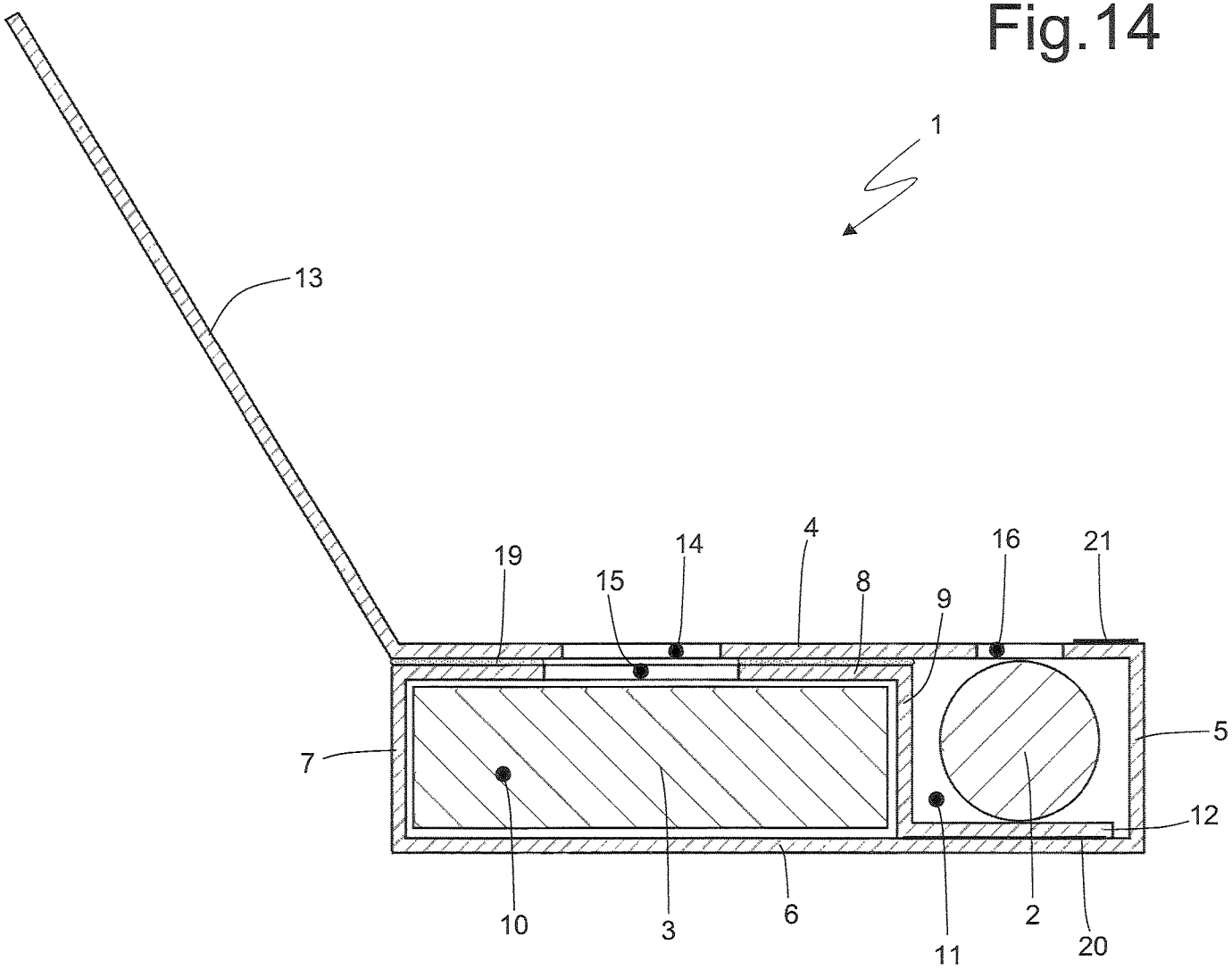
FIG. 14 is a cross-section of the rigid box of FIG. 1 in an open configuration and devoid of its own content.

In FIG. 1, number 1 indicates as a whole a parallelepiped-shaped rigid box designed to contain (at least) one smoking article 2 (illustrated schematically in FIGS. 13, 14 and 15) and if necessary (at least) one accessory or gadget 3 (schematically illustrated in FIGS. 13, 14 and 15). By way of example, the smoking article 2 could be a cigar wrapped in a packing material preferably transparent and waterproof (for example of polypropylene or similar); however, according to other and perfectly equivalent embodiments, the smoking article 2 may be different from a cigar, for example a complete electronic cigarette or (at least) a replacing cartridge for an electronic cigarette. By way of example, the accessory or gadget 3 could be a lighter or a match box.

As illustrated in FIGS. 1-4, the rigid box 1 has a parallelepiped shape and has an upper wall and a bottom wall opposite and parallel to each other, a front wall and a rear wall opposite and parallel to each other, and two lateral walls opposite and parallel to each other. In particular, the rigid box 1 comprises a panel 4 which defines the upper wall, a panel 5 which is hinged to the panel 4, is folded 90° with respect to panel 4 and defines a lateral wall, a panel 6 which is hinged to the panel 5, is folded 90° with respect to the panel 5, is parallel to and faces the panel 4, and defines the bottom wall, a panel 7 which is hinged to the panel 6, is folded 90° with respect to panel 6, is parallel to and faces the panel 5, and defines the other lateral wall, and a panel 8 which is hinged to the panel 7, is folded 90° with respect to panel 7 and rests on and is glued to an inner surface of the panel 4. In addition, the box 1 comprises a rigid panel 9 which is hinged to the panel 8, is folded 90° with respect to panel 8, is parallel to the panel 5 and to the panel 7, and divides the inner volume of the rigid box 1 in two adjacent chambers 10 and 11, and a panel 12 which is hinged to the panel 9, is folded 90° with respect to panel 9, and rests on and is glued to an inner surface of the panel 6. The chamber 10 is bounded laterally by the panel 7 (towards the outside) and by panel 9 (towards the inside), is bounded at the top by the panel 8 (glued to an inner surface of the panel 4), and is bounded at the bottom by the panel 3; the chamber 11 is bounded laterally by the panel 2 (towards the outside) and by the panel 9 (towards the inside), is bounded at the top by the panel 4, and is bounded at the bottom by the panel 3.

As illustrated in FIG. 14, the chamber 10 is designed to contain the accessory 3 and is larger, while the chamber 11 is designed to contain the smoking article 2 and is smaller; of course, according to other embodiments not illustrated and perfectly equivalent, the two chambers 10 and 11 may have different dimensional proportions (for example may have the same size or the chamber 11 could be bigger). In addition, according to other embodiments not illustrated and perfectly equivalent, both chambers 10 and 11 may contain respective smoking articles 3, or a smoking article 3 could be housed in the chamber 10 instead of in the chamber 11.

Furthermore, the box 1 comprises a rigid panel 13, which is hinged to the panel 4 from the opposite side to the panel 5 and constitutes a pivoting lid which may cover the panel 4 itself. In other words, the pivoting lid made by the panel 13 is hinged to the panel 4 defining the upper wall to rotate with respect to the panel 4 itself between a closed position (illustrated in FIG. 1) in which the lid rests on the panel and covers the whole panel 4 itself and an open position (illustrated in FIGS. 2-4) in which the lid is separated from the panel 4 and leaves exposed the panel 4 itself.

According to a preferred (but not binding) embodiment, the panel 4 has (at least) one through-hole 14 which is formed at the chamber 10 so as to leading inside the chamber 10 itself, and the panel 8 has (at least) one through-hole 15 which is formed at the chamber 10 and is aligned with and superimposed on the through-hole 14. Preferably, the through-hole 15 is (slightly) larger than the through-hole 14 so that an edge of the through-hole 14 is completely contained (with a certain tolerance) within an edge of the through-hole 15; in this way the edge of the through-hole 15 is never visible through the through-hole 14 also taking into account the inevitable production and positioning tolerances of the through-holes 14 and 15 to benefit the aesthetic aspect. In other words, if the two through-holes 14 and 15 were identical in size, it would require a very high precision both in their production, and in the positioning thereof to ensure a perfect alignment between the through-holes 14 and 15; however, said high precision is difficult to achieve in a packing machine, and then (minor) misalignments would frequently occur that would expose the edge of the underlying through-hole 15 through the through-hole 14 with an extremely unpleasant effect. Said problem is completely resolved in a very simply way by making the through-hole 15 (slightly) larger than the through-hole 14.

According to a preferred (but not binding) embodiment, the panel 4 has (at least) another through-hole 16 which is formed at the chamber 11 so as to lead inside the chamber 11 itself.

The function of the holes 14, 15 and 16 is to offer from above (i.e. through the upper wall formed by the panel 4) a view (partial) of the contents of the chambers 10 and 11 (i.e. of the smoking article 2 and of the accessory 3 if present). Obviously, if one of the two chambers 10 and 11 is empty (i.e. if the accessory 3 is not present) then usually neither the corresponding hole 14 (and the respective hole 15) nor 16 is present.

The panel 4 comprises two tabs 17 (better illustrated in FIG. 3), which are hinged to the panel 4 at the opposite ends of the panel 4, are folded 90° with respect to panel 4, and respectively define part of the front wall and part of the rear wall; similarly, the panel 6 comprises two tabs 18, which are hinged to the panel 6 at the opposite ends of the panel 6, are folded 90° with respect to panel 6, are superimposed and glued to the tabs 17, and define part of the front wall and part of the rear wall. Preferably (but not obligatorily) the tabs 17 constitute an outer part of the front and rear walls, and then the tabs 18 constitute an inner part of the front and rear walls; in other words, the tabs 17 are glued on an outer surface of the tabs 18, and then completely cover the tabs 18 themselves.

According to a possible embodiment, the tabs 17 have a transverse dimension (slightly) greater than the tabs 18, so that the transverse edges of the tabs 18 are completely covered by the tabs 17; in this way the transverse edges of the tabs 18 are never visible even taking into account the inevitable production and positioning tolerances of the tabs 17 and 18 to benefit the aesthetic aspect. In other words, if the tabs 17 and 18 had identical transverse dimensions, a very high precision both in production, and in the positioning thereof would be required to ensure a perfect alignment between the corresponding transverse edges; however, said high precision is difficult to achieve in a packing machine and then (minor) misalignments would frequently occur having a particularly unpleasant aesthetic effect. Said problem is completely resolved very simply by producing the tabs 17 (slightly) larger crosswise than the tabs 18.

As illustrated in the attached figures, the edges of the panels 5 and 7 (i.e. of the lateral walls) coincide with the edges of the tabs 17 and 18 (i.e. of the front and rear walls) and therefore there is no through-opening between the edges of the panels 5 and 7 (i.e. of the lateral walls) and the edges of the tabs 17 and 18 (i.e. of the front and rear walls). According to an alternative embodiment not illustrated, the edges of the panels 5 and 7 (i.e. of the lateral walls) are spaced apart from the edges of the tabs 17 and 18 (i.e. of the front and rear walls) to define corresponding through openings between the edges of the panels 5 and 7 (i.e. of the lateral walls) and the edges of the tabs 17 and 18 (i.e. of the front and rear walls). Said result may be obtained by producing the panels 5 and 7 (i.e. the lateral walls) narrower and/or by producing the tabs 17 and 18 (i.e. the front and rear walls) narrower; in other words, to define the through openings between the edges of the tabs 17 and 18 (i.e. of the front and rear walls) and the edges of the panels 5 and 7 (i.e. of the lateral walls), the panels 5 and 7 (i.e. the lateral walls) may have a lesser longitudinal extension with respect to the panel 4 (i.e. to the top wall) and to the panel 6 (i.e. to the bottom wall) and/or the tabs 17 and 18 (i.e. the front and rear walls) may have a lesser longitudinal extension with respect to the panel 4 (i.e. to the top wall) and to the panel (i.e. to the bottom wall). The function of said through openings between the edges of the tabs 17 and 18 (i.e. of the front and rear walls) and the edges of the panels 5 and 7 (i.e. of the lateral walls) is to provide a vision (partial) of the contents of the chamber 10 and 11 (i.e. of the smoking article 2 and of the accessory 3 if present). A further function of said through openings between the edges of the tabs 17 and 18 (i.e. of the front and rear walls) and the edges of the panels 5 and 7 (i.e. of the lateral walls) is to facilitate the tear-off removal of the front and rear walls for the axial extraction of the smoking article 2 and, if present, of the accessory 3 (as will be better described hereinafter).

Figure 4:
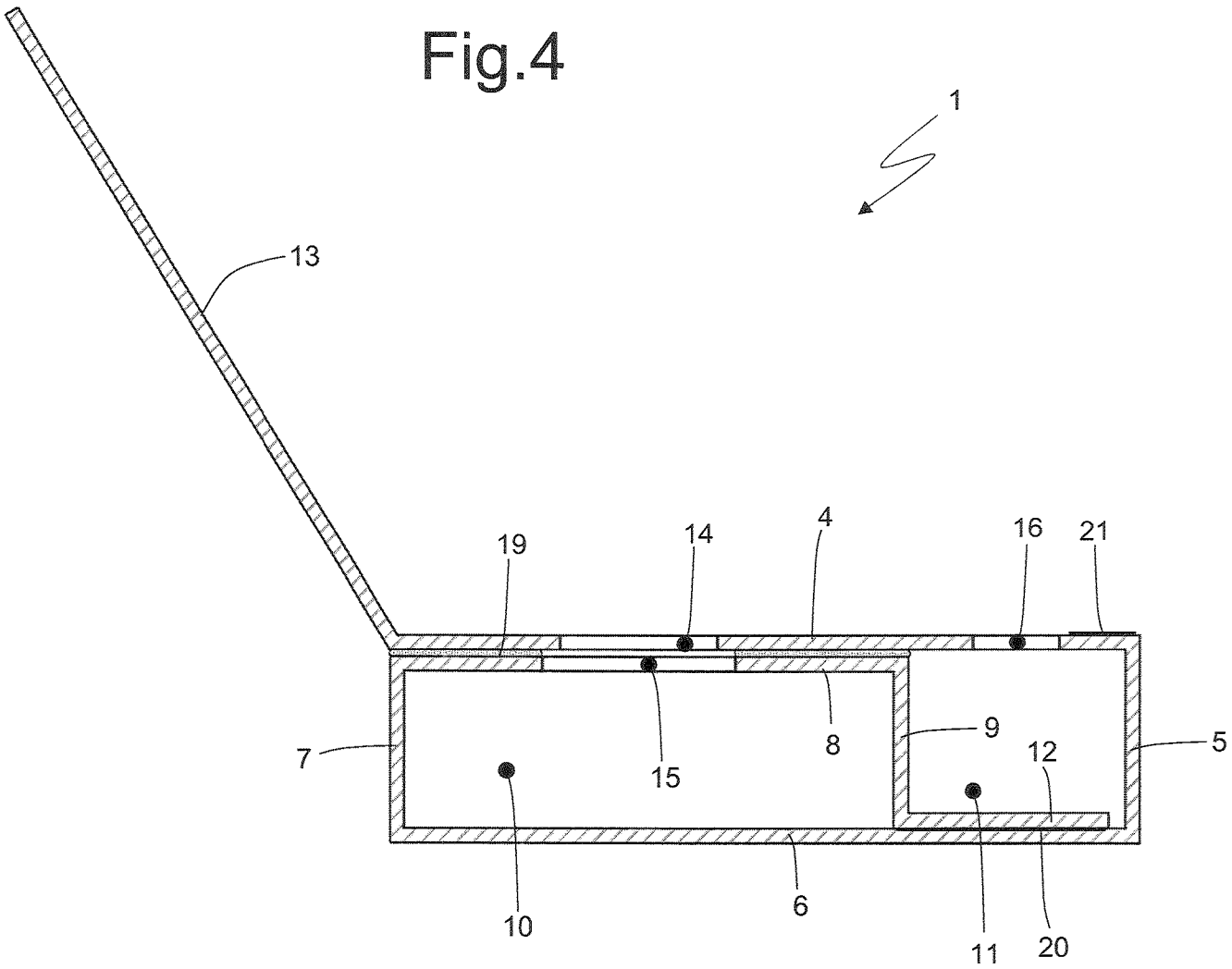
FIG. 4 is a cross-sectional view of the rigid box of FIG. 1 in an open configuration and devoid of its own content.

As illustrated in FIG. 4, the shape of the rigid box 1 is stabilized by interposing glue 19 between the panel 4 and the panel 8 (obviously outside of the holes 14 and 15) to glue together the panels 4 and 8 and by interposing glue 20 between the panel 6 and the panel 12 to glue the panels 6 and 12. In addition, the front wall and the rear wall are stabilized by interposing glue between the corresponding tabs 17 and 18 to glue the corresponding tabs 17 and 18 themselves.

Figure 2:
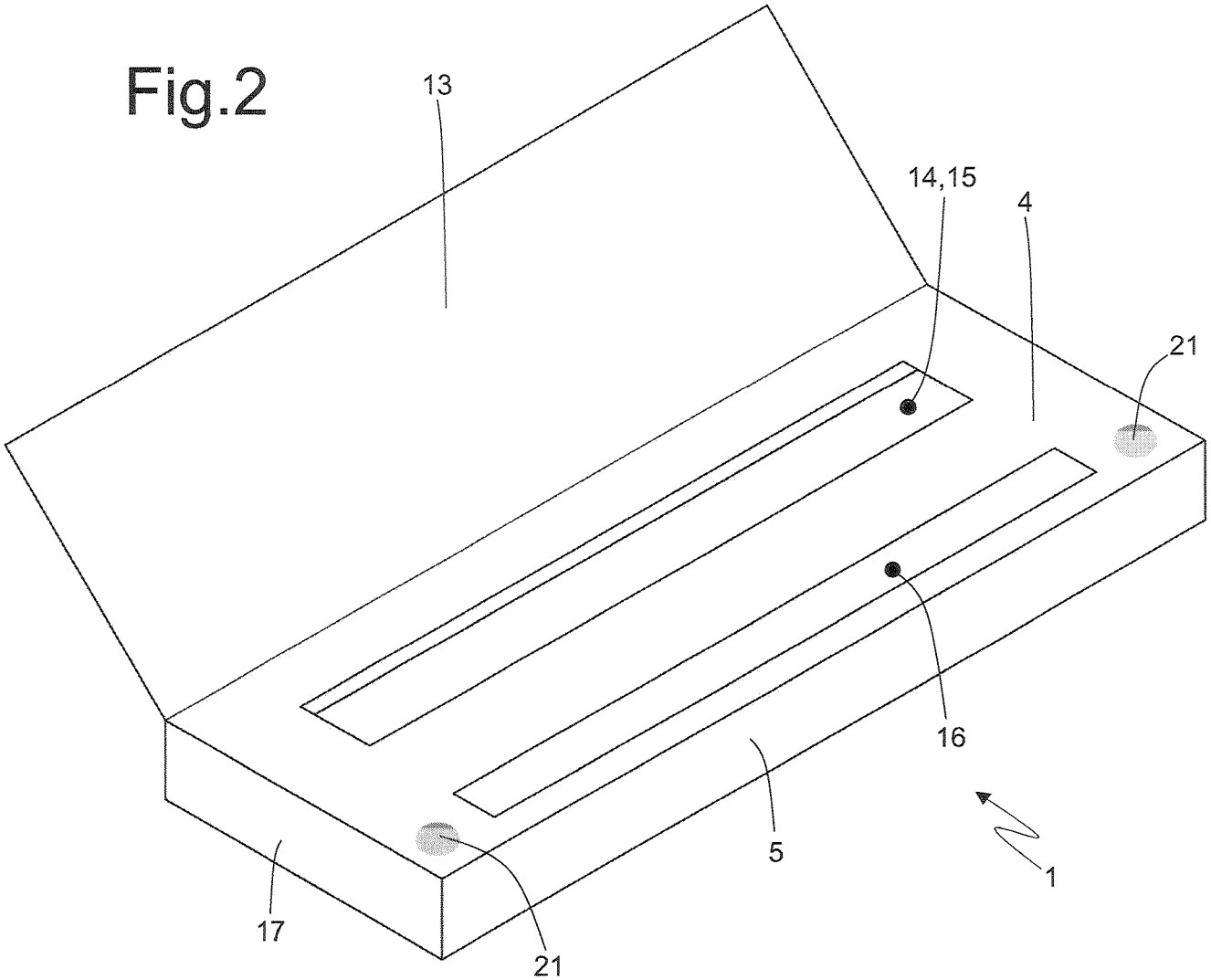
FIG. 2 is a front perspective view of the rigid box of FIG. 1 in an open configuration and devoid of its own content.
Figure 3:
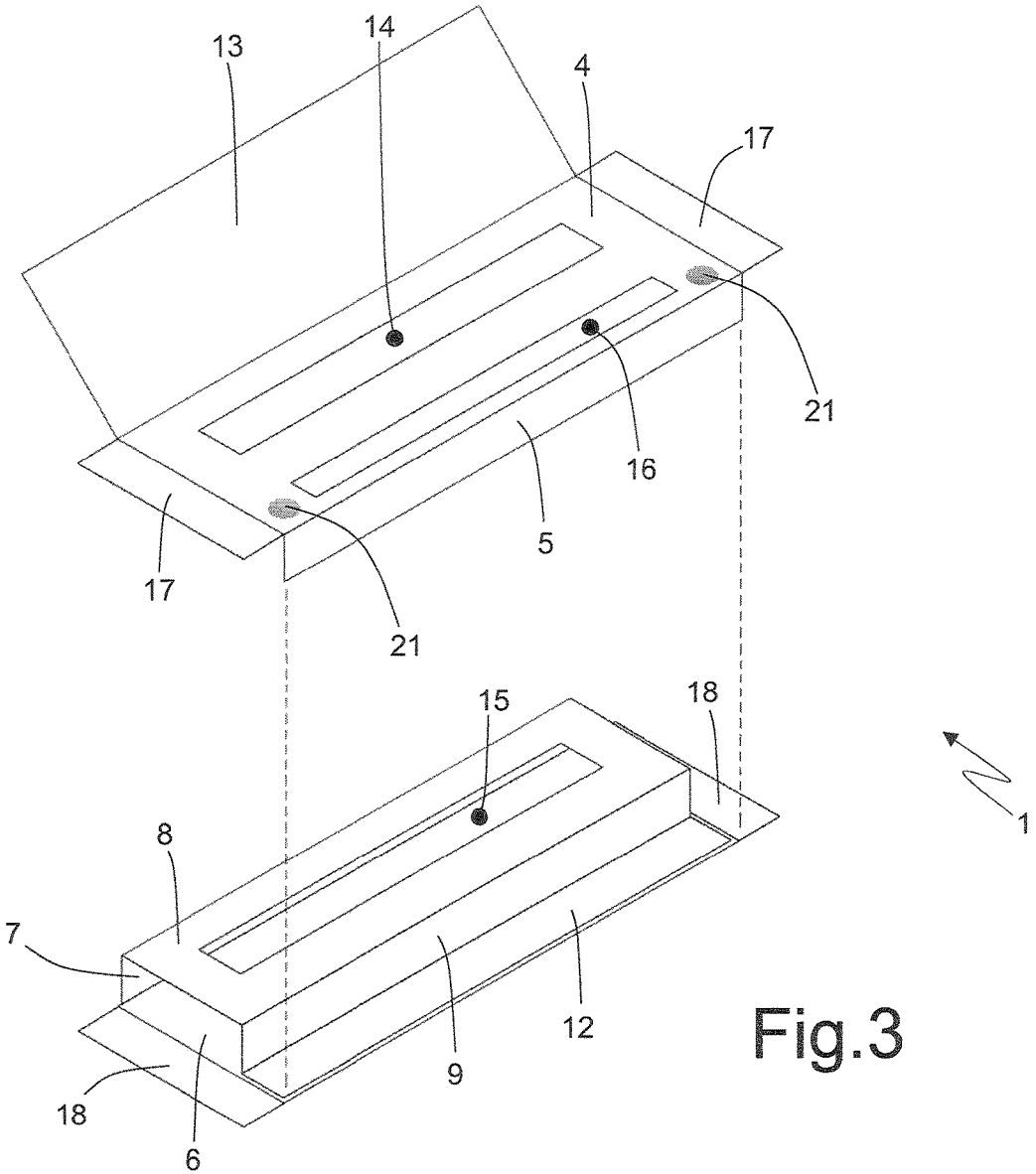
FIG. 3 is a front perspective view and partially exploded of the rigid box of FIG. 1 in an open configuration and devoid of its own content.

As illustrated in FIGS. 2, 3 and 4, between the panel 13 and the panel 4 glue 21 is interposed which determines a temporary gluing between the panels 4 and 13 and allows the separation of the panel 13 (i.e. of the lid) from the panel 4 (i.e. from the top wall) at the opening of the rigid box 1. The function of the glue 21 is to keep the panel 13 (i.e. the lid) adhering to the panel 4 (i.e. to the upper wall) during the handling of the rigid box 1. According to a possible embodiment, the glue 21 interposed between the panel 13 and the panel 4 is non-dry, re-stick glue; in this way, the glue 21 acts (i.e. keeps the panel 13 adhering to the panel 4) even after the first opening of the rigid box 1. Alternatively, the glue 21 interposed between the panel 13 and the panel 4 is a weak-stick glue that is broken (by ceasing altogether its effect) at the first opening of the rigid box 1.

In use, the user can examine the content of the rigid box 1 by opening the panel 13 (i.e. the lid), and then observing from above the chambers 10 and 11 through the corresponding through-holes 14, 15 and 16 (i.e. through the through-holes 14, 15 and 16 the user can see from above the smoking article 2, and if present, the accessory 3). To extract the article 2 and, if present, the accessory 3 from the corresponding chambers 10 and 11, the user generally breaks the front wall (consisting of two tabs 17 and 18 superimposed and glued one to the other) and/or the rear wall (consisting of two tabs 17 and 18 superimposed and glued one to the other) and then axially pulls out the article 2 and, if present, the accessory 3. To facilitate the breaking of the front and rear walls, the fold lines that separate said walls (i.e. the tabs 17 and 18) from the corresponding panels 4 and 6 may be pre-weakened to be easily torn-off (for example may be constituted by a succession of small, spaced apart through cuts). The tearing-off of the front and rear walls (i.e. of the tabs 17 and 18) can be facilitated by the fact that the edges of the tabs 17 and 18 (i.e. the edges of the front and rear walls) can be found at a certain distance from the edges of the panels 5 and 7 (i.e. of the lateral walls) and therefore it is simple and intuitive to put a finger between the edge of a lateral wall and the edge of the front or rear wall to pull outwards and then tear-off the front or rear one.

Figure 5:
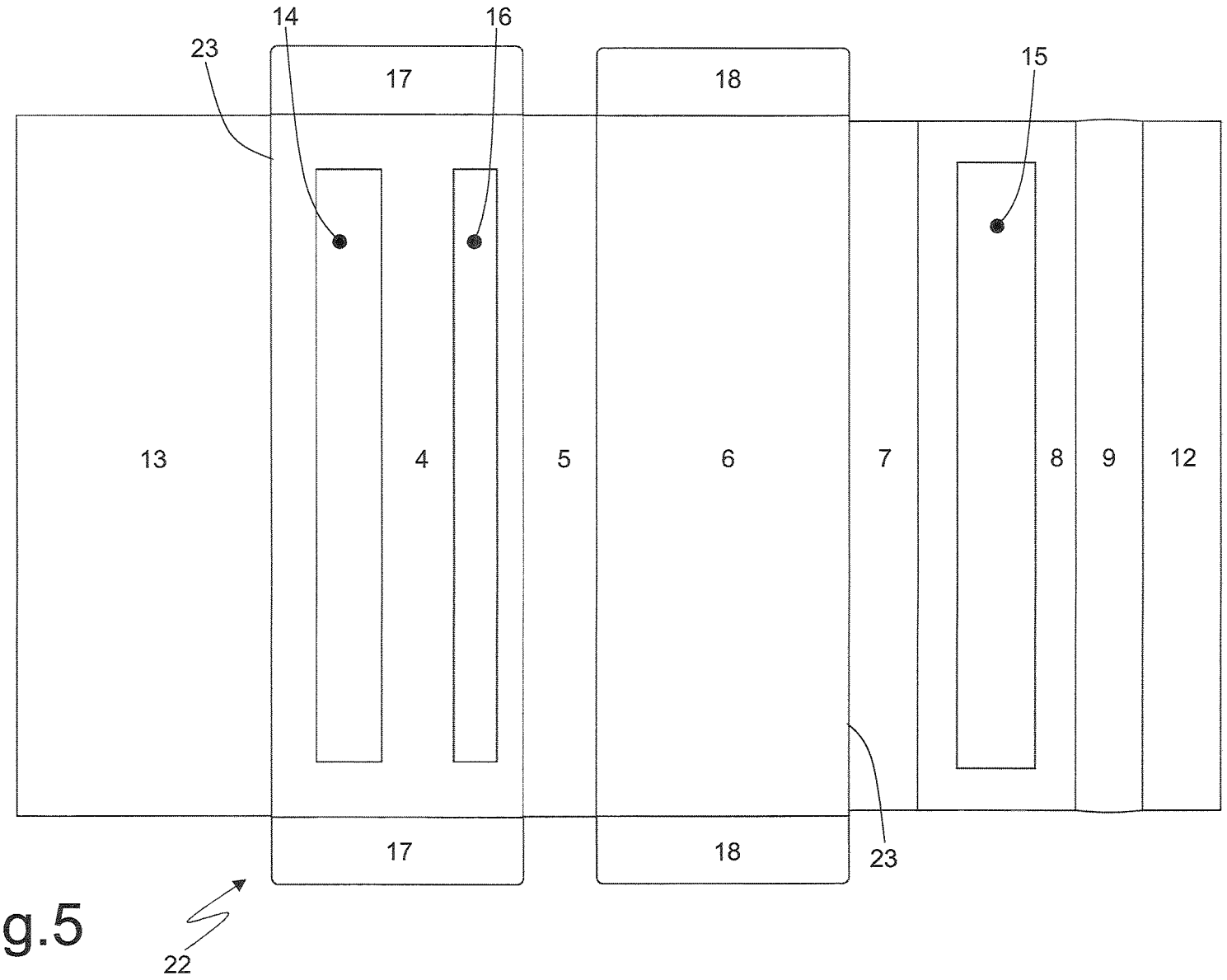
FIG. 5 is a plan view of a blank completely laid out flat and used to produce the rigid box of FIG. 1.

As illustrated in FIG. 5, the rigid box 1 is obtained by folding a flat blank 22, substantially having an elongated rectangular shape. The blank 22 has a plurality of longitudinal pre-weakened lines 23, which define (from left to right) the panel 13, the panel 4, the panel 5, the panel 6, the panel 7, the panel 8, the panel 9 and the panel 12.

The methods for folding the blank 22 to produce the rigid box 1 described below, with particular reference to the blank 22 illustrated in FIG. 5 and to the folding sequence illustrated in FIGS. 6-11.

Initially and preliminarily, the panel 13 is superimposed and glued (by means of the glue 21) to the panel 4; this operation may be performed upstream of a packing machine which produces the rigid box 1 (i.e. before the blank 22 is fed to the packing machine), or even inside the same packing machine.

Figure 6:
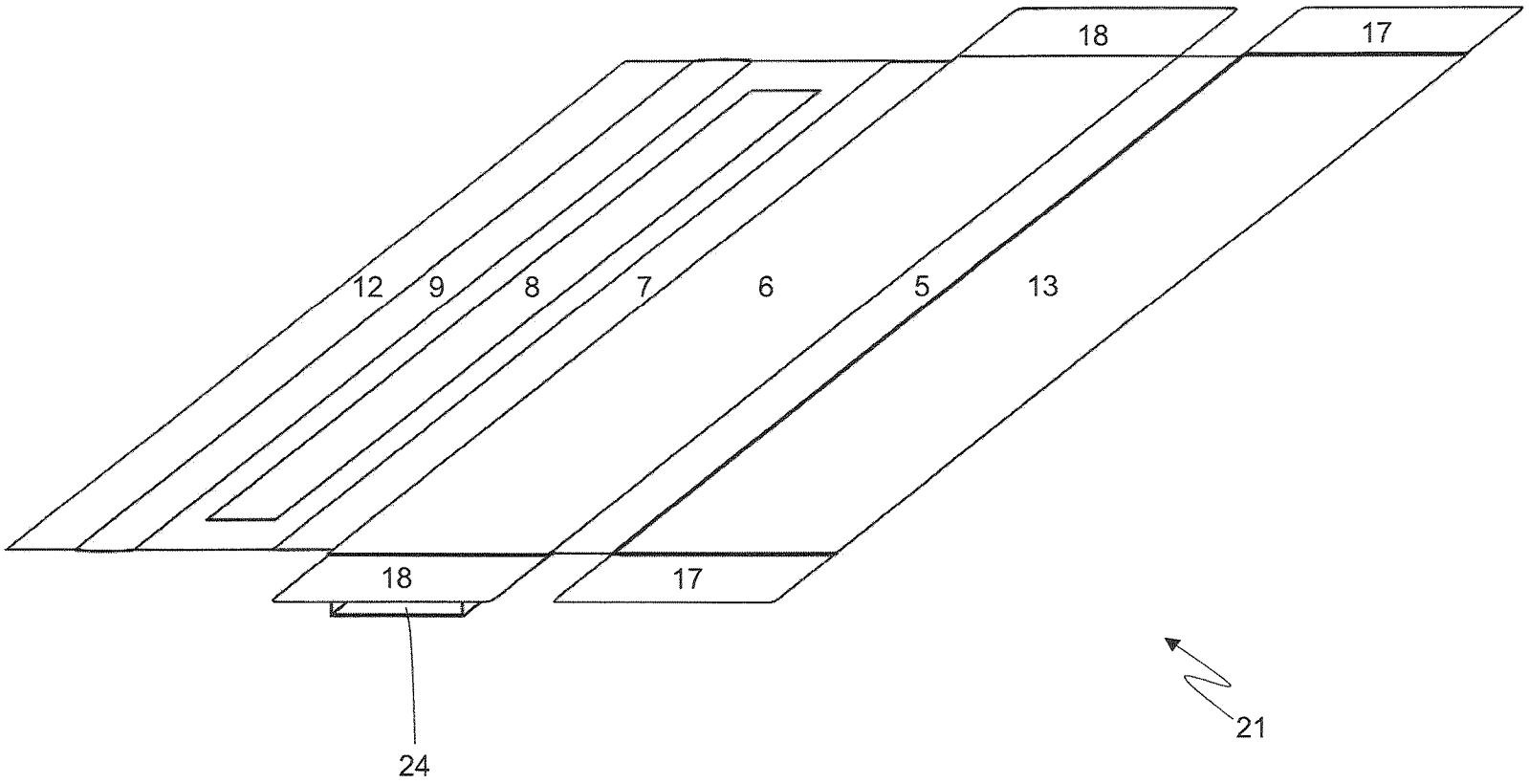
FIGS. 6-11 are six perspective views illustrating respective folding steps of the blank of FIG. 5.
Figure 7:
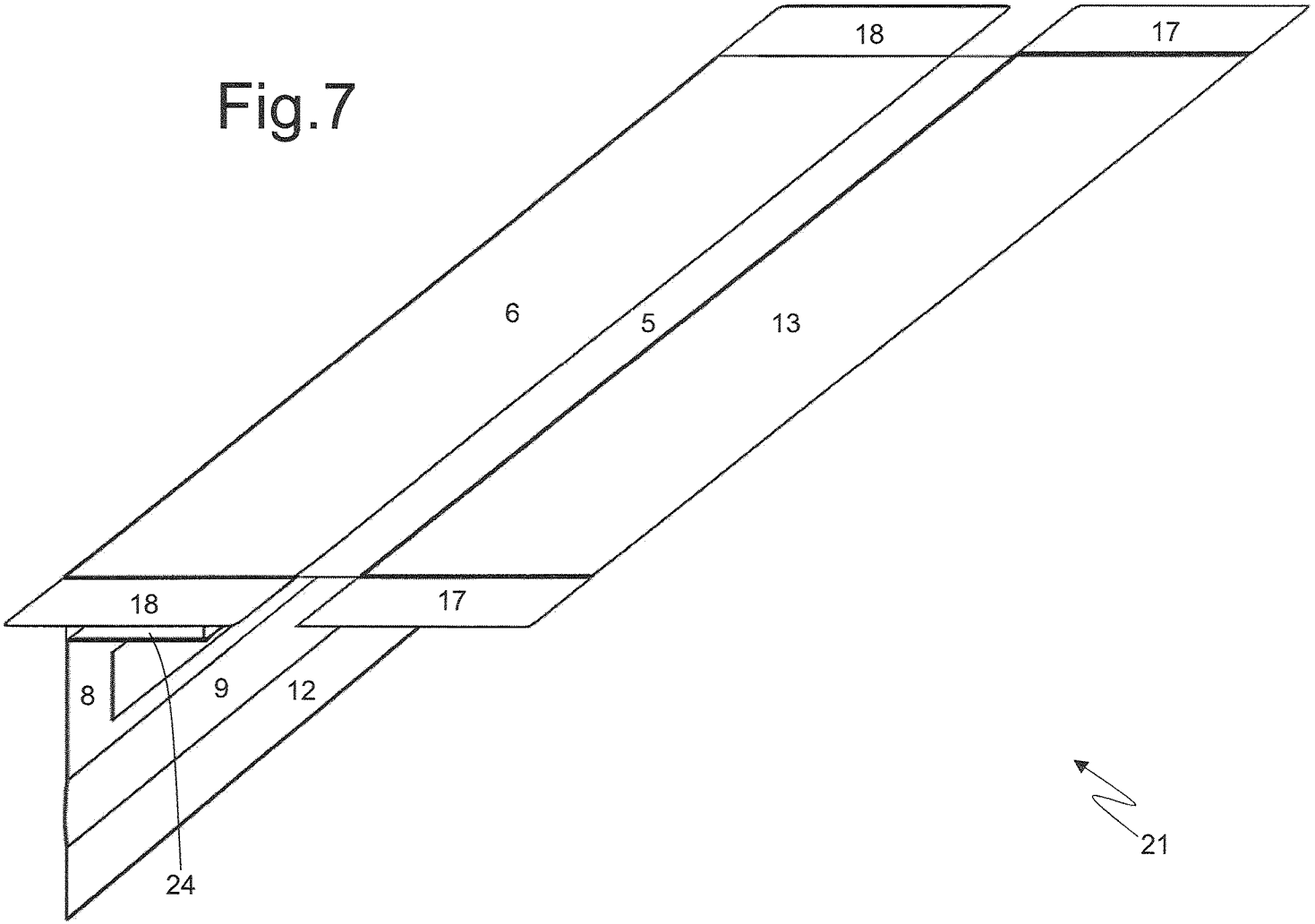
Figure 8:
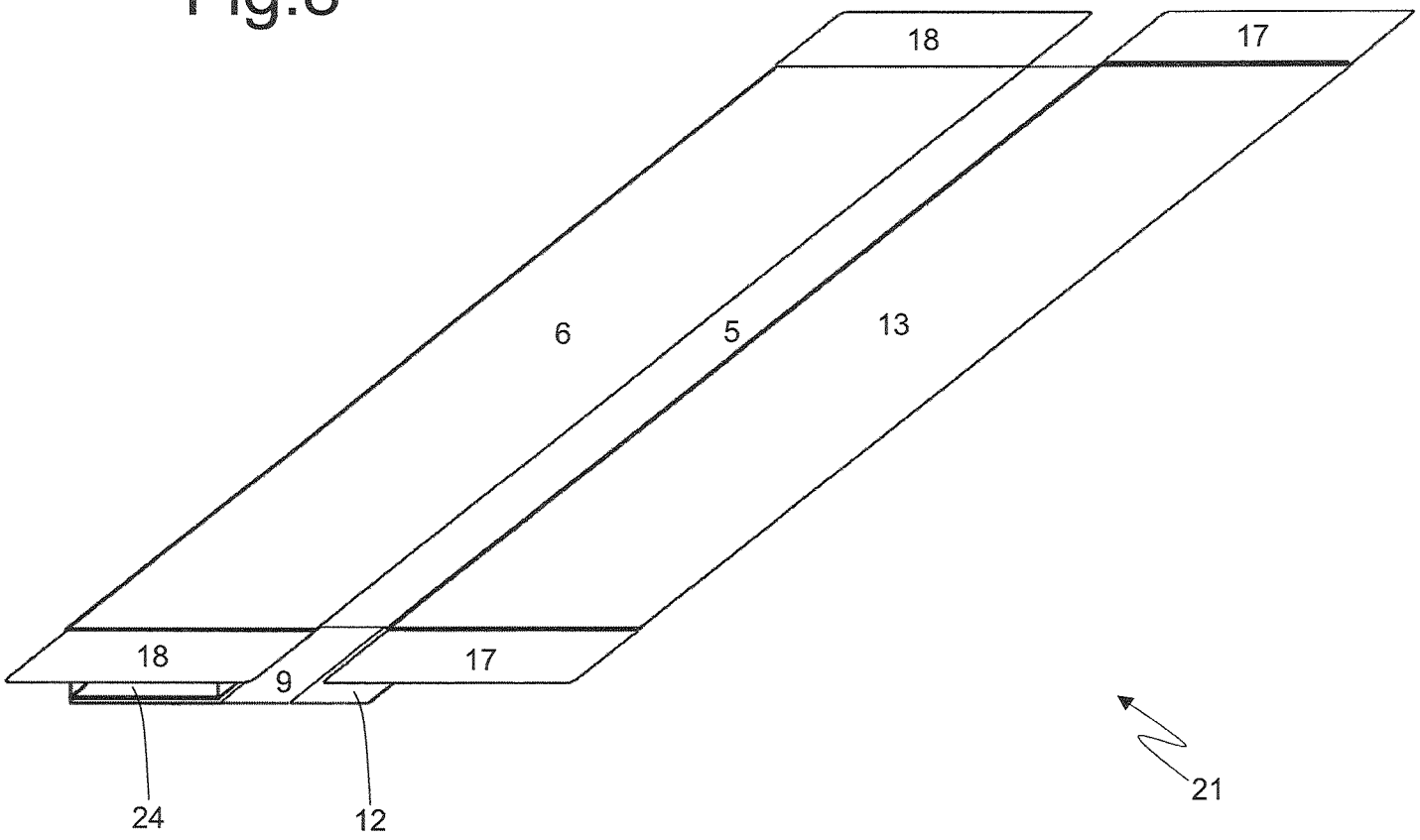
Figure 9:
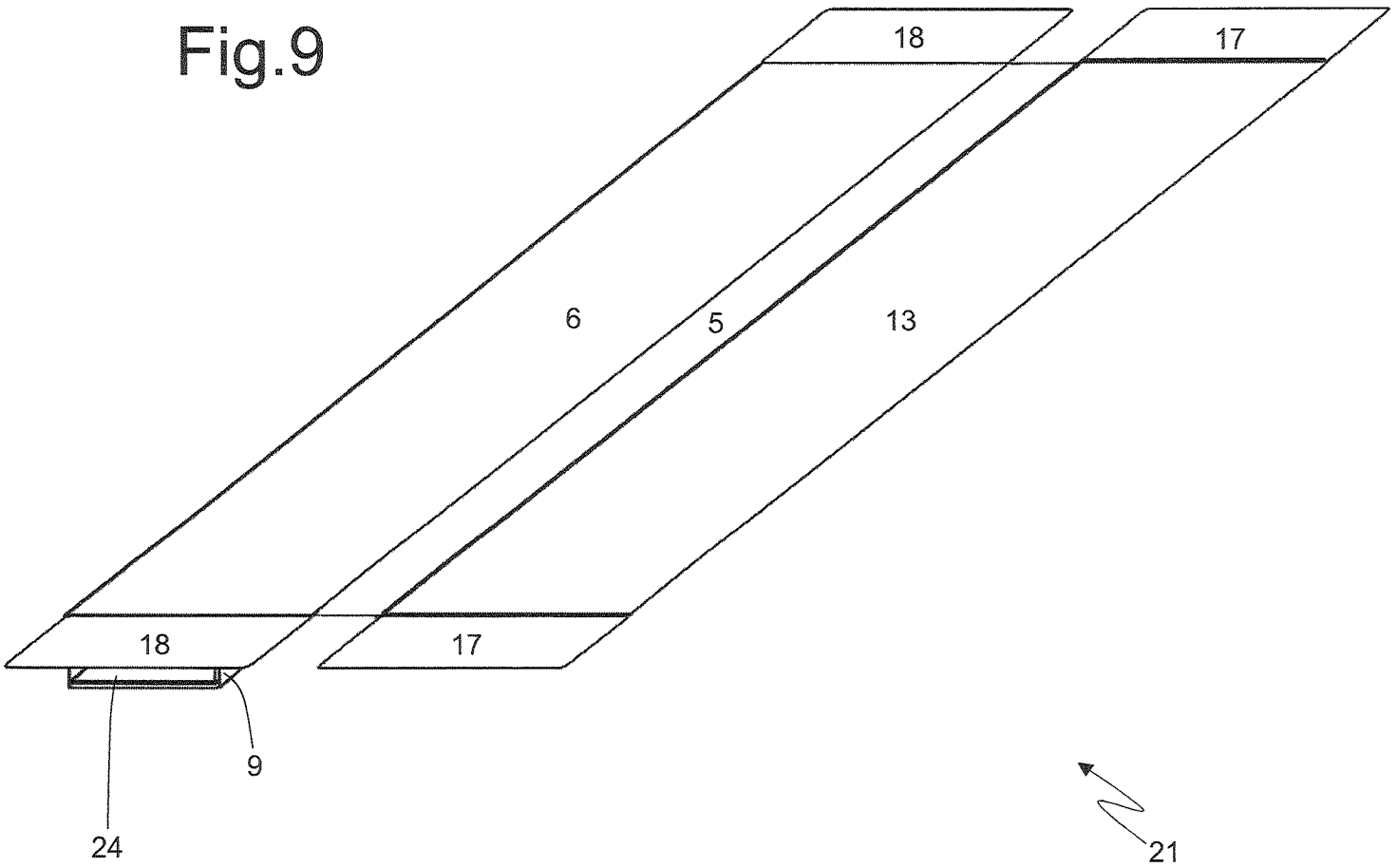
Figure 10:
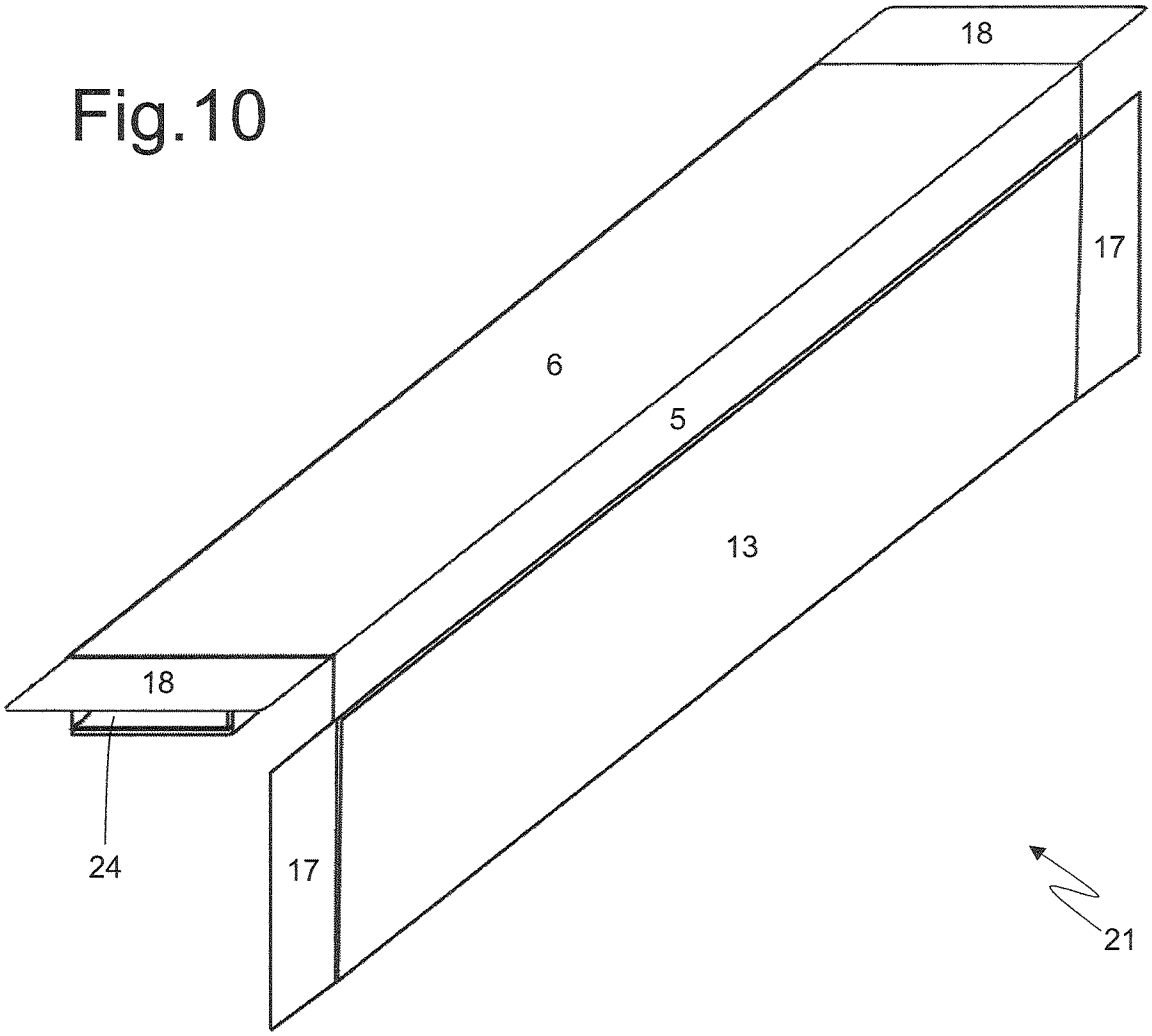
Figure 11:
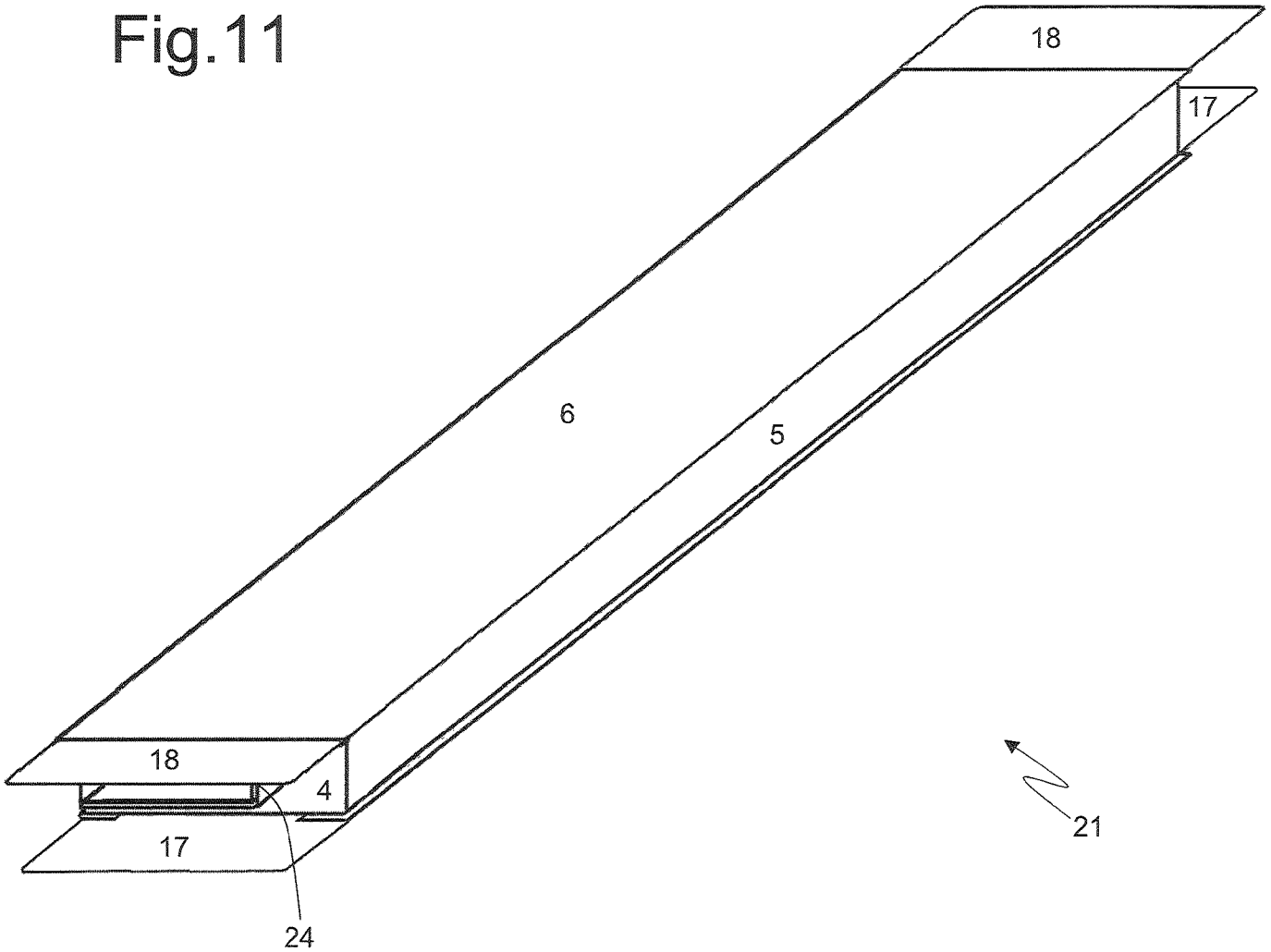
Figure 12:
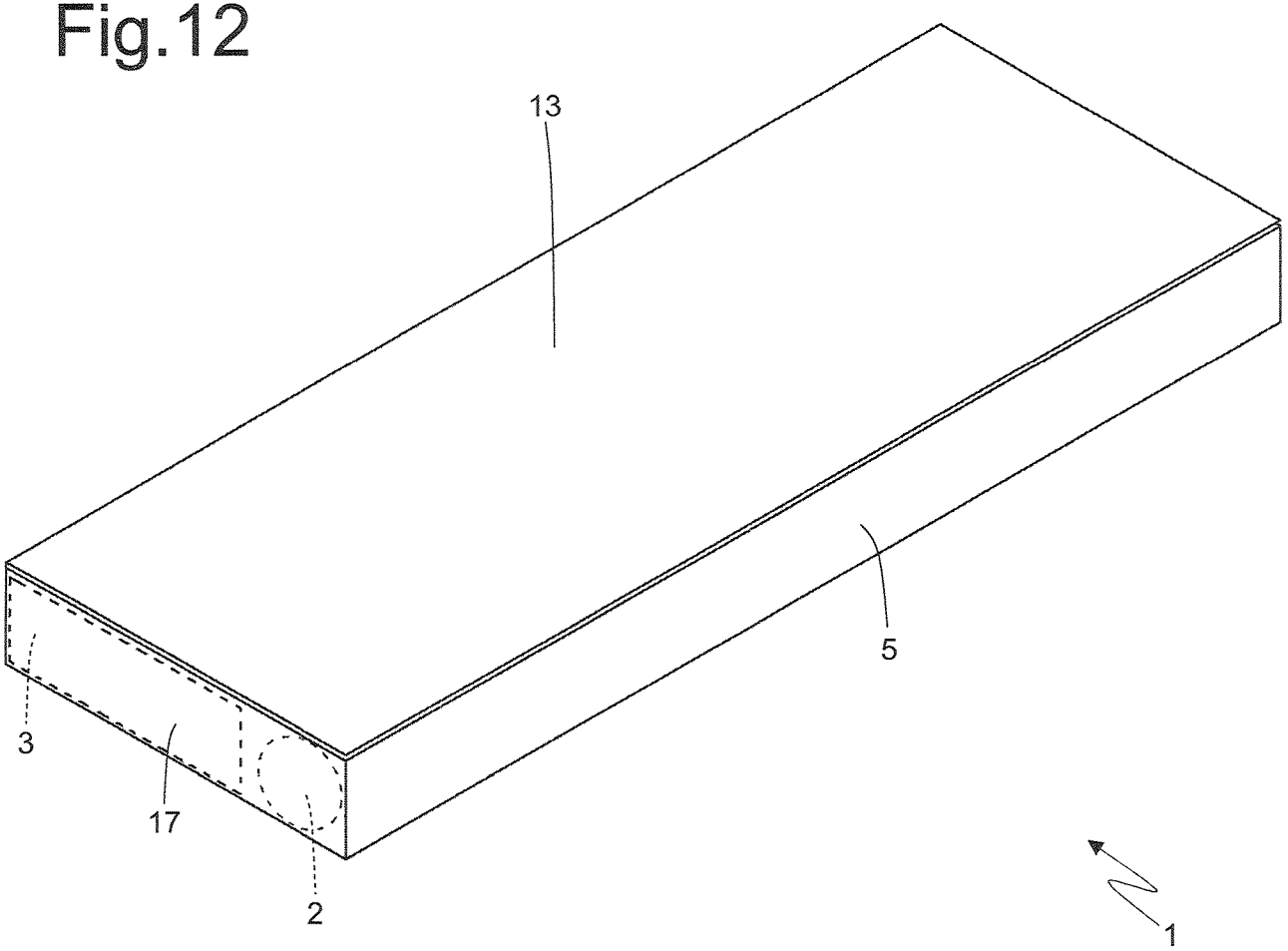
FIG. 12 is a front perspective view of the rigid box of FIG. 1 in a closed configuration and devoid of its own content.

Once superimposed and glued (by means of glue 21), the panel 13 to the panel 4, the panel 6 is placed on a folding spindle 24 of a tubular and parallelepiped shape (generally hollow inside) having the same dimensions of the chamber 10 (as illustrated in FIG. 6). Subsequently, the panel 7 is folded 90° with respect to panel 6 and onto the folding spindle 24 (as illustrated in FIG. 7). Subsequently, the panel 8 is folded 90° with respect to panel 7 and onto the folding spindle 24 (as illustrated in FIG. 8). Subsequently, the panel 9 is folded 90° with respect to panel 8 and onto the folding spindle 24 and simultaneously the panel 9 is folded 90° with respect to panel 9 and onto an inner surface of the panel 6 (as illustrated in FIG. 9); before this operation, between the panel 6 and the panel 12 the glue 20 (which may be deposited either on the panel 6 or on the panel 12) is interposed which determines the gluing between the panels 6 and 12 themselves. Subsequently, the panel 5 is folded 90° with respect to panel 6 (as illustrated in FIG. 10). Subsequently, the panel 4 (together with the panel 13) is folded 90° with respect to panel 5 and onto an outer surface of the panel 8 (as illustrated in FIG. 11); before this operation, between the panel 4 and the panel 8 glue 19 is interposed (which may be deposited either on the panel 4 or on the panel 8) which determines the gluing between the panels 4 and 8 themselves.

At this point, the folding spindle 24 is withdrawn axially from the chamber 10 of the rigid box 1 (i.e. the chamber 10 of the rigid box 1 is pulled axially from the folding spindle 24), and then the smoking article 2 and, if present, the accessory 3 are inserted axially into the corresponding chambers 10 and 11. Once the smoking article 2, and if present, the accessory 3 have been inserted axially in the corresponding chambers 10 and 11, the tabs 18 are folded 90° with respect to the panel 6 and, subsequently, the tabs 17 are folded 90° with respect to the panel 4 to be superimposed on the previously folded tabs 18; before this operation, between the tabs 17 and 18 glue is interposed (which may be deposited either on the tabs 17 or the tabs 18) which determines the gluing between the tabs 17 and 18 themselves. Obviously, it is possible to complete the production of the front wall or of the rear wall before inserting axially the smoking article 2, and if present, the accessory 3 in the corresponding chambers 10 and 11 and then complete the construction of the rear wall or front wall after inserting axially the smoking article 2, and if present, the accessory 3 in the corresponding chambers 10 and 11.

The rigid box 1 described above has numerous advantages.

First, the rigid box 1 described above offers very good mechanical protection to the contents (i.e. to the smoking article 2, and if present, to the accessory 3); in fact, the rigid box 1 is particularly robust due to the presence of the panel 9 which constitutes an inner reinforcement rib and thanks to the fact that the areas on which glue 19 and 20 is applied are particularly extensive (and thus guarantee a very tenacious adhesion both between the panel 4 and the panel 8, and between the panel 6 and the panel 12).

In addition, the rigid box 1 described above requires the use of a relatively modest amount of packing material. In this regard it is important to observe that the blank 22 used to produce the rigid box 1 described above and illustrated in FIG. 5 has a quite rectangular shape and thus the production thereof does not involve a large amount of cut-offs (the blanks are always made by punching starting from a strip of perfectly rectangular cardboard).

Finally, the rigid box 1 described above is also easy to manufacture as it can be produced in a conventional automatic packing machine; or changes to be made to a conventional automatic packing machine to produce the rigid box 1 described above are contained and substantially trivial.

The invention claimed is:

1. A rigid box (1) for smoking articles; the rigid box (1) being parallelepiped-shaped and comprises:

a first panel (4) which defines a top wall;

a second panel (5) which is hinged to the first panel (4), is folded 90° with respect to the first panel (4) and defines a first lateral wall;

a third panel (6) which is hinged to the second panel (5), is folded 90° with respect to the second panel (5), is parallel to and faces the first panel (4), and defines a bottom wall;

a fourth panel (7) which is hinged to the third panel (6), is folded 90° with respect to the third panel (6), is parallel to and faces the second panel (5), and defines a second lateral wall opposite the first lateral wall;

a fifth panel (8) which is hinged to the fourth panel (7), is folded 90° with respect to the fourth panel (7) and rests on and is glued to an inner surface of the first panel (4);

a sixth panel (9) which is hinged to the fifth panel (8), is folded 90° with respect to the fifth panel (8), is parallel to the second panel (5) and to the fourth panel (7) and divides the inner volume of the rigid box (1) in two adjacent chambers (10, 11);

a seventh panel (12) which is hinged to the sixth panel (9), is folded 90° with respect to the sixth panel (9) and rests on and is glued to an inner surface of the third panel (6); and an eighth panel (13), which is hinged to the first panel (4) from the opposite side of the second panel (5), is folded 180° with respect to the first panel (4) onto the first panel (4) and constitutes a pivoting lid which covers the first panel (4); and wherein between the eighth panel (13) and the first panel (4) glue (21) is interposed which allows to separate the eighth panel (13) from the first panel (4) at an opening of the rigid box (1).

2. The rigid box (1) according to claim 1, wherein at least a first chamber (10) bounded laterally by the fourth panel (7) and by the sixth panel (9) is designed to contain a smoking article (3).

3. The rigid box (1) according to claim 2, wherein:

the first panel (4) has at least a first through-hole (14) which is formed at, and which comes out inside the first chamber (10); and the fifth panel (8) has at least a second through-hole (15) which is formed at the first chamber (10) and is aligned and superimposed to the first through-hole (14).

4. The rigid box (1) according to claim 3, wherein the second hole (15) is larger than the first hole (14) so that an edge of the first hole (14) lies completely within an edge of the second hole (15).

5. The rigid box (1) according to claim 1, wherein at least a second chamber (11) bounded laterally by the sixth panel (9) and by the second panel (5) is designed to contain a smoking article (3).

6. The rigid box (1) according to claim 5, wherein the first panel (4) has at least a third through-hole (16) formed at, and which comes out inside the second chamber (11).

7. The rigid box (1) according to claim 1 wherein the glue (21) interposed between the eighth panel (13) and the first panel (4) is non-dry, re-stick glue.

8. The rigid box (1) according to claim 1, wherein the glue (21) interposed between the eighth panel (13) and the first panel (4) is weak-stick glue which yields the first time the rigid box (1) is opened.

9. The rigid box (1) according to claim 1, wherein:

the first panel (4) comprises two first tabs (17), which are hinged to the first panel (4) at the opposite ends of the first panel (4), are folded 90° with respect to the first panel (4), and define part of a front wall and part of a rear wall respectively; and the third panel (6) comprises two second tabs (18), which are hinged to the third panel (6) at the opposite ends of the third panel (6), are folded 90° with respect to the third panel (6), are superimposed and glued to the first tabs (17), and define part of the front wall and part of the rear wall.

10. The rigid box (1) according to claim 9, wherein the first tabs (17) have a transverse dimension greater than the second tabs (18).

11. The rigid box (1) according to claim 9, wherein the edges of the first and second tabs (17, 18) are at a given distance of other than zero from the edges of the second panel (5) and of the fourth panel (7) to define corresponding through openings.

12. The rigid box (1) according to claim 9, wherein at least some fold lines that separate the first and second tabs (17, 18) from the first panel (4) and from the third panel (6) are pre-weakened tear lines.

13. A method for producing a rigid box (1) for smoking articles; the rigid box (1) being parallelepiped-shaped and being produced by folding a blank (22) comprising:

a first panel (4) which defines a top wall;

a second panel (5) which is hinged to the first panel (4) and defines a first lateral wall;

a third panel (6) which is hinged to the second panel (5) and defines a bottom wall;

a fourth panel (7) which is hinged to the third panel (6) and defines a second lateral wall opposite the first lateral wall;

a fifth panel (8) which is hinged to the fourth panel (7);

a sixth panel (9) which is hinged to the fifth panel (8) and is designed to divide the inner volume of the rigid box (1) in two adjacent chambers (10, 11);

a seventh panel (12) which is hinged to the sixth panel (9); and an eighth panel (13), which is hinged to the first panel (4) from the opposite side of the second panel (5), is folded 180° with respect to the first panel (4) and constitutes a pivoting lid which covers the first panel (4) itself;

the method comprises the steps of:

placing the third panel (6) on a parallelepiped-shaped folding spindle (24) having the same size as a first chamber (10);

superimposing and gluing the eighth panel (13) onto the first panel (4) before placing the third panel (6) on the folding spindle (24);

folding the fourth panel (7) 90° with respect to the third panel (6) and onto the folding spindle (24);

folding the fifth panel (8) 90° with respect to the fourth panel (7) and onto the folding spindle (24);

folding the sixth panel (9) 90° with respect to the fifth panel (8) and onto the folding spindle (24) and simultaneously folding the seventh panel (12) 90° with respect to the sixth panel (9) and gluing onto an inner surface of the third panel (6);

folding the second panel (5) 90° with respect to the third panel (6); and folding the first panel (4) 90° with respect to the second panel (5) and gluing onto an outer surface of the fifth panel (8).

14. The method according to claim 13, wherein:

the first panel (4) comprises two first tabs (17), which are hinged to the first panel (4) at the opposite ends of the first panel (4) and define part of a front wall and part of a rear wall respectively; and the third panel (6) comprises two second tabs (18), which are hinged to the third panel (6) at the opposite ends of the third panel (6) and define part of the front wall and part of the rear wall; and further steps of: folding 90° the second tabs (18) with respect to the third panel (6), and folding 90° the first tabs (17) with respect to the first panel (4) to superimpose the first tabs (17) on the second tabs (18) are provided.

15. The method according to claim 14 and comprising the further steps of:

withdrawing the folding spindle (24) axially from the rigid box (1) before completing the folding of the first and second tabs (17, 18); and inserting at least one product (2, 3) axially inside the two adjacent chambers (10, 11) of the rigid box (1) before completing the folding of the first and second tabs (17, 18).

* * * * *